US005517790A

United States Patent [19]

Jennings

[11] Patent Number: 5,517,790

[45] Date of Patent: May 21, 1996

[54] CERAMIC MONUMENT

[76] Inventor: Monty C. Jennings, 8 Martin, Belmont, N.Y. 14813

[21] Appl. No.: 404,239

[22] Filed: Mar. 15, 1995

[51] Int. Cl.[6] ..... E01F 9/011

[52] U.S. Cl. ..... 52/103; 52/168; 47/79

[58] Field of Search ..... 52/103, 105, 168, 52/104; 47/79 C, 79 R

[56] References Cited

U.S. PATENT DOCUMENTS 4,058,940 11/1979 McBrayer ..... 52/104
4,304,076 12/1981 Splendora ..... 52/104
4,463,527 8/1984 Schlosser ..... 52/103

*Primary Examiner*—Creighton Smith
*Attorney, Agent, or Firm*—Howard J. Greenwald

[57] ABSTRACT

A monument assembly contaiing a monument attached to a base. The base is in the shape of an open container, and its walls (and the walls of the monument) are each from about 0.5 to about 1.0 inches thick and are comprised of at least about 90 weight percent of ceramic material. The monument is an integral assembly containing an interior chamber; it contains a device for charging water to the interior chamber, a device for removing water from the interior chamber, and at least one device for for removably attaching the monument to the base.

15 Claims, 4 Drawing Sheets

CERAMIC MONUMENT

FIELD OF THE INVENTION

A hollow monument structure consisting essentially of ceramic material.

BACKGROUND OF THE INVENTION

Grave monuments are well known to those skilled in the art. Thus, by way of illustration and not limitation, reference may be had to design U.S. Pat. No. 259,369 of Splendora (which discloses a transparent monument containing a decorative object within it), design U.S. Pat. No. 310,419 of Morvant (which discloses a permanent photographic memorial marker), and U.S. Pat. No. 3,938,286 of Mochinski (a grave marker comprised of a lucite block), 3,962,836 of Carnes et al. (a grave marker with a transparent cover), 4,058,940 of McBrayer (a monument marker comprised of a clear plastic outer laminate), 4,202,144 of Patterson (a cemetery monument), 4,227,325 of Whitford (a grave marker comprised of a cylindrical chamber within which is mounted a picture), 4,259,381 of Narita (an ornament for burial monuments which contains a transparent body), 4,304,076 of Splendora (a transparent monument), 4,337,109 of Narita ( a process for preparing a burial ornament), 4,428,168 and 4,428,169 of Tomer (a permanent floral decoration for use on grave sites), 4,550,537 of Smith (a grave monument), and the like. The disclosure of each of these United States patents is hereby incorporated by reference into this patent application.

Many of the prior art monuments are solid devices made out of granite. They are heavy, expensive, and require a substantial amount of labor to construct and move. Furthermore, the granite monuments will often support the growth of vegetation (such as lichen, moss, and the like) and be subject to attack by acid rain. Despite the substantial costs of such monuments, they often within a period of about twenty years cease to serve their intended functions of indicating information about the individuals buried beneath them.

It is an object of this invention to provide a monument which is substantially less expensive to produce and easier to manipulate than prior art granite monuments.

It is another object of this invention to provide a monument which will not support the growth of vegetation as readily as do granite monuments.

It is yet another object of this invention to provide a monument which is less subject to attack to acid rain than are granite monuments.

These and other objects of the invention will be apparent upon a reading of this specification.

SUMMARY OF THE INVENTION

In accordance with this invention, there is provided a monument structure comprised of a monument attached to base. The base and monument are constructed from relatively thin walls of ceramic material. Orifices communicate between the monument and the base and allow the flow of water therebetween.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
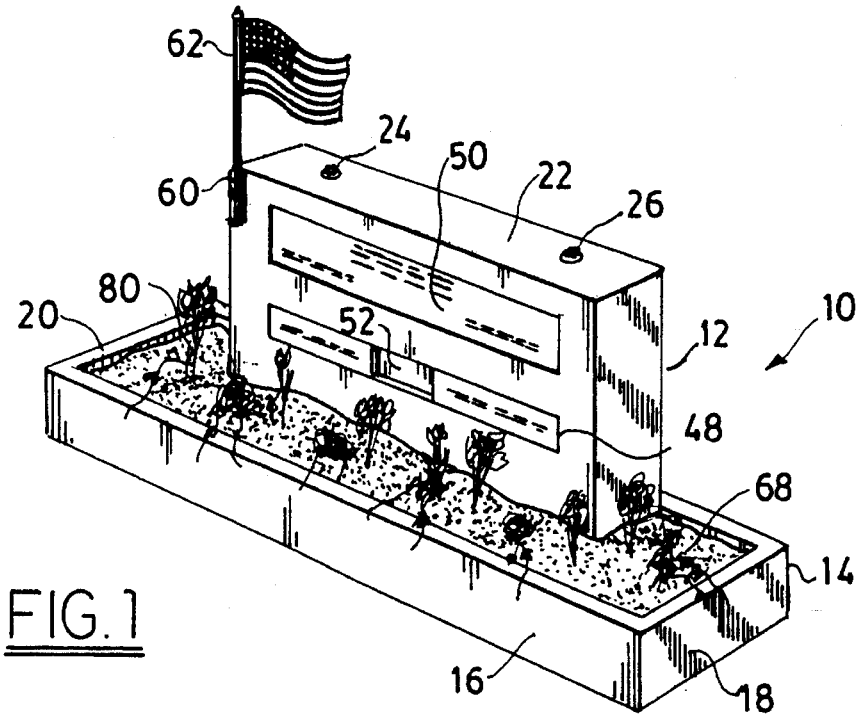
FIG. 1 is a perspective view of one preferred embodiment of the monument structure of the invention.
Figure 10:
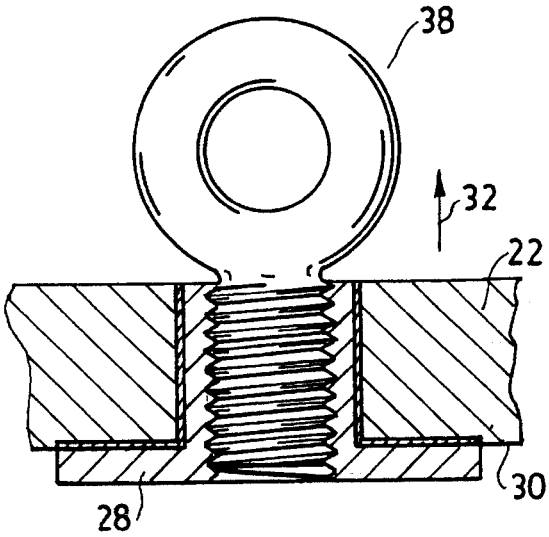
FIG. 10 is a sectional view of eye bolt used with the monument of FIG. 1.

FIG. 1 is a perspective view of the monument structure 10 of this invention. Referring to FIG. 10, it will be seen that monument structure 10 is comprised of monument 12 and base 14.

Each of monument 12 and base 14 is preferably an integral structure comprised of relatively thin walls. Thus, referring to FIG. 1, it will be seen that base wall is comprised of front wall 16, right wall 18, left wall 20, back wall 22, and bottom wall (not shown in FIG. 1, but see bottom wall 24 of FIG. 5).

It is preferred that each of the walls of monument 12 and base 14 be at least about 0.5 inches thick. In one preferred embodiment, each of such walls is from about 0.5 to about 1.0 inches thick. In an even more preferred embodiment, each of such walls is from about 0.5 to about 0.8 inches.

Each of the walls of monument 12 and base 14 preferably comprise at least about 90 weight percent of ceramic material and, more preferably, at least about 95 weight percent of ceramic material. In one preferred embodiment, reinforcing rods (such as those made from fiberglass) may be used to strengthen the walls of the monument and/or base.

The term ceramic, as used in this specification, refers to a class of inorganic, nonmetallic products which are subjected to a temperature of 540 degrees or more during manufacture or use, and it includes metallic oxides, borides, carbides, or nitrides, and mixtures or compounds of such material.

In one preferred embodiment, the ceramic material used is terra cotta. As is known to those skilled in the art, terra cotta is an unglazed, low-fired ornamental earthenware material. Thus, one may use one or more of the terra cotta materials disclosed in U.S. Pat. Nos. 5,247,762 (terra cotta reservoir), 5,189,835 (terra cotta reservoir), 4,255,200, and the like. The disclosure of each of these United States patents is hereby incorporated by reference into this specification.

In another preferred embodiment, the ceramic material used is a stoneware clay composition. As is known to those skilled in the art, stoneware clay is a semirefractory plastic clay which will fire to a dense, vitrified body of high strength; see, e.g., A.S.T.M. C242. One may use one or more of the stoneware compositions described in the prior art such as, e.g., those described in U.S. Pat. Nos. 5,352,396, 5,315, 922, 5,275,989 (stoneware composition), 4,542,058, 4,119, 470 (stoneware composition), 3,487,140, and the like. The disclosure of each of these United States patents is hereby incorporated by reference into this specification.

By way of further illustration, the monument 12 and/or base 14 may be made by casting liquid clay, or terra cotta clay, into plaster molds. The casting of green bodies using clay or clay-containing compositions is well-known to those skilled in the art and is described, e.g., in U.S. Pat. Nos. 5,372,179 (casting mold), 5,362,692 (casting slip), 5,356, 575, 5,340,107, 5,266,252, 5,156,855 (slip casting), 5,153, 155 (clay slurry), 5,143,871, 4,659,749 (casting mixture), 3,7000,472, and the like. The disclosure of each of these United States patents is hereby incorporated by reference into this specification.

In one preferred embodiment, plastic clay is used to prepare the monument 12 and/or base 14. As is known to those skilled in the art, plastic lay is any clay which will form a moldable mass when blended with water. See, e.g., U.S. Pat. Nos. 4,857,256 and 4,786,457, the disclosures of which are hereby incorporated by reference into this specification.

In one preferred embodiment, the monument 12 and the base 14 are made by forming green bodies by casting a clay composition, or a terra cotta composition, into plaster molds. The green bodies thus produced are finished and dried and fired.

In one preferred embodiment, the exterior walls of monument 12 and base 14 are glazed by conventional processes and thereafter fired. Thus, one may use one or more of the glaze compositions and/or glaze processes disclosed in U.S. Pat. Nos. 5,370,783 (ceramic glaze), 5,366,763 (vitreous glaze), 5,362,687 (lead-free frit glaze), 5,300,324, 5,256, 179, 5,238,881 (glass frit glaze), 5,194,296 (glaze slip), 4,839,313, 4,790,110, 4,308,183, 4,276,204, and the like. The disclosure of each of these United States patents is hereby incorporated by reference into this specification.

Referring again to FIG. 1, it will be seen that, in the preferred embodiment illustrated, monument 12 has a substantially rectilinear shape. However, it will be apparent to those skilled in the art that, in the monument structure of this invention, other monument shapes may be used.

As is known to those skilled in the art, a monument is an inscribed stone or other marker erected as a memorial. Monuments are well known to those skilled in the art. Thus, e.g., reference may be had to U.S. Pat. No. 3,938,286, which discloses an integral body having a generally upright member with a top and bottom and having a decorative exterior bearing identifying indicia. Thus, e.g., reference may be had to U.S. Pat. Nos. 3,962,836, 945,721, and 2,046,594. Thus, e.g., reference also may also be had to U.S. Pat. Nos. 4,058,940 and 2,124,143, U.S. Pat. No. 4,169,970 (which discloses tombstones and memorial monuments), U.S. Pat. No. 4,202,144, U.S. Pat. No. 4,227,325 (which discloses a grave marker having a base, a marker, and a chamber for displaying pictures, photographs and the like), U.S. Pat. No. 4,304,076, U.S. Pat. No. 4,550,537, and U.S. Pat. Nos. 4,202,144, 4,009,547 (monument base), D243,466, 5,014, 472, 3,857,214 (method of making tombstones), 3,481,089 (memorial marker with removable indicia), 3,477,181 (tombstone frames), and the like. The disclosure of each of these United States patents is hereby incorporated by reference into this specification.

Referring again to FIG. 1, and in the preferred embodiment depicted therein, it will be seen that the top 22 of monument 12 is comprised of a first plug 24 and a second plug 26. These plugs are shown in greater detail in FIGS. 9, 10, and 11.

Figure 9:
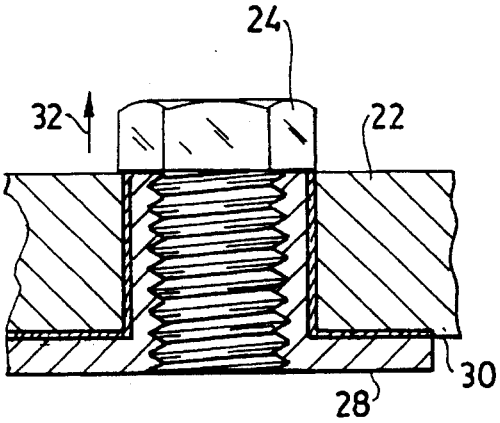
FIG. 9 is a sectional view of a plug used in the monument of FIG. 1.

Referring to FIG. 9, and in the preferred embodiment depicted therein, it will be seen that plug 24 is removably disposed within an orifice in top wall 22 of monument 12. In the embodiment depicted, the plug 24 is screwably connected to a flange 28, which fits within said orifice and is contiguous with the bottom surface 30 of top wall 22 of monument 12. When force is applied in the direction of arrow 32 on plug 24, the flange 28 tends to keep plug 24 disposed within wall 22.

Figure 6:
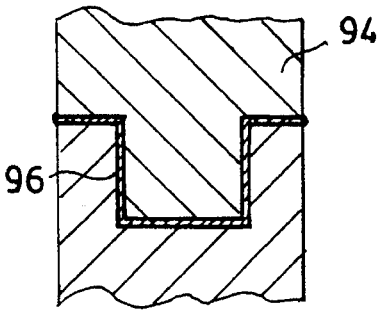
FIG. 6 is a partial sectional view illustrating one preferred means of attaching the monument to the base.

Referring to FIG. 6, plug 24 may be removed from wall 22, thereafter liquid 32 may be added to the interior 34 of monument 12 by pouring said liquid 32 in the direction of arrows 36, and, after a suitable amount of such liquid 32 has been added, the plug 24 may be reinstalled.

Figure 11:
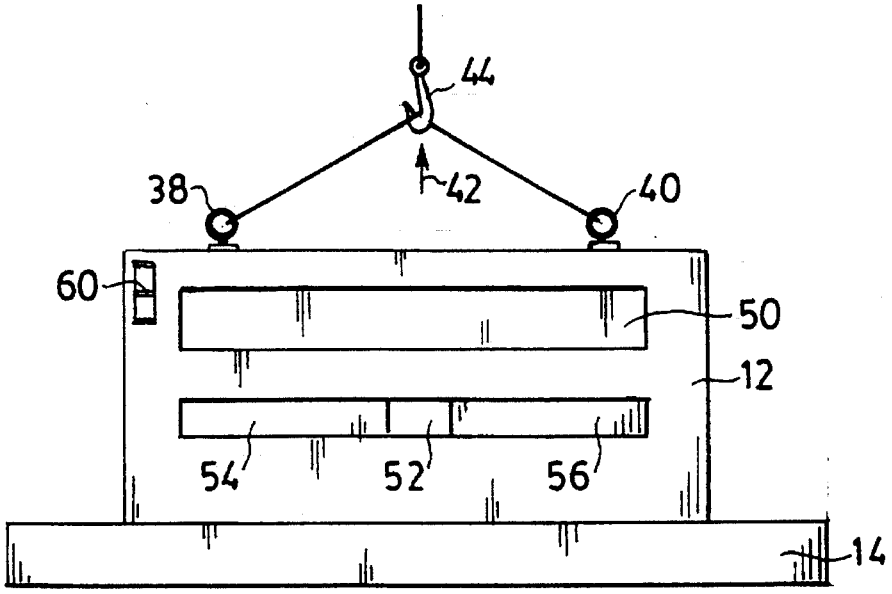
FIG. 11 illustrates one preferred means of removing the monument of FIG. 1 from the base of FIG. 1.

Referring to FIG. 10, the plug 24, and/or the plug 26, may be replaced with an eye bolt 38, which may be secured within wall 22 in the same manner as plugs 24 and/or 26. As is illustrated in FIG. 11, when two such eye bolts (eye bolt 38 and eye bolt 40) are so installed, the monument 12 may be separated from the base 14 by exerting force in the direction of arrow 42 by conventional means such as, e.g., hook and tackle 44.

Figure 12:
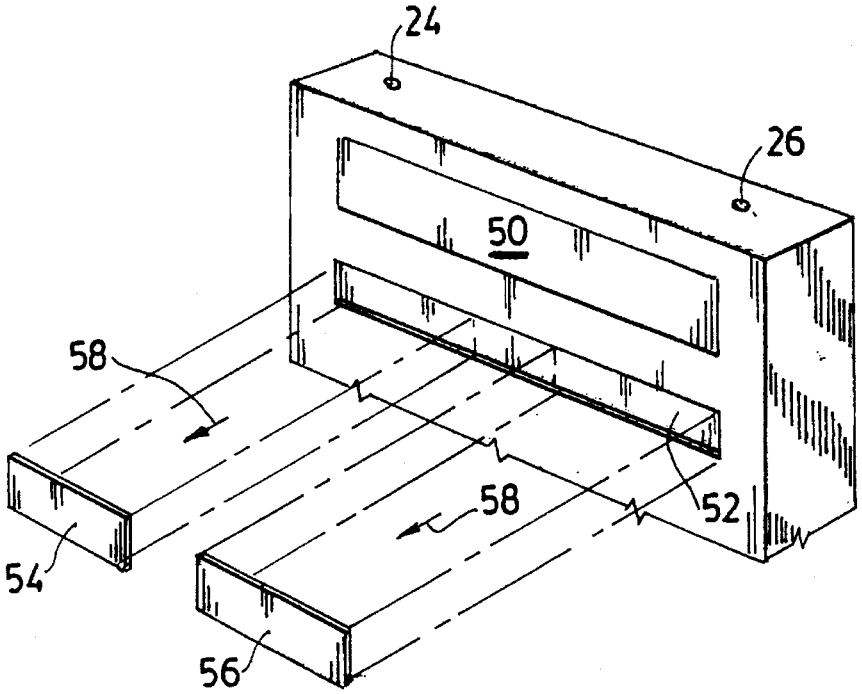
FIG. 12 is an exploded view of the monument of FIG. 1.

Referring again to FIG. 1, and in the preferred embodiment depicted therein, it will be seen that the front face 48 of monument 12 is comprised of recesses 50 and 52 (which may, e.g., be about groove adapted to receive a plate) adapted to receive one or more plates with indicia or inscriptions or designs or colors on them. Thus, referring to FIG. 12, two such plates 54 and 56 are shown. In the embodiment depicted, they may be removed from recess 52 by applying force in the direction of arrows 58 and may be reinserted by applying force in the opposite direction. In another embodiment, the plates 54 and 56 are permanently affixed within groove 52 by suitable means such as, e.g., adhesive.

Referring again to FIG. 1, it will be seen that attached to monument 12 is flag holder 60 in which United States flag 62 is preferably disposed. One may insert flags of other entities to whom one owes allegiance, such as the Buffalo Bills.

One may use any of the flag holders known to those skilled in the art such as, e.g., one or more of the flag holders described in U.S. Pat. Nos. 5,309,862, 5,236,166, 5,197,408, 5,087,012, 5,028,031, 3,952,981, 3,941,340, 3,903,835, 3,825,214, 3,722,841, D342,895 (lighted flag holder), and the like. The disclosure of each of these United States patents is hereby incorporated by reference into this specification.

Figure 7:
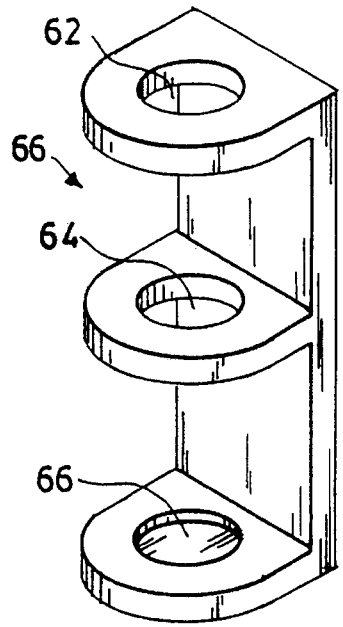
FIG. 7 is a perspective view of a flag holder which may be used on the structure of FIG. 1.

FIG. 7 is a perspective view of one preferred flag holder 60 which is comprised of orifices 62 and 64 and recess 66, which is adapted to receive the bottom of the flag pole.

Figure 2:
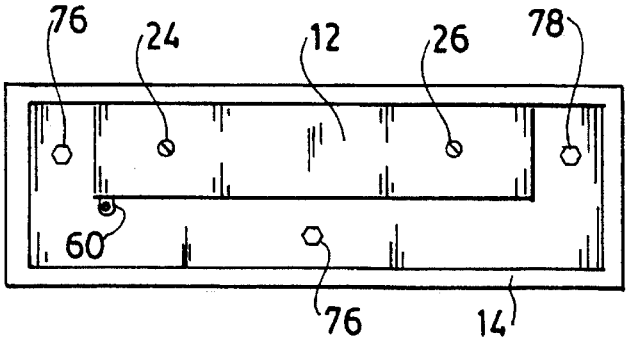
FIG. 2 is a top view of the monument depicted in FIG. 1.
Figure 3:
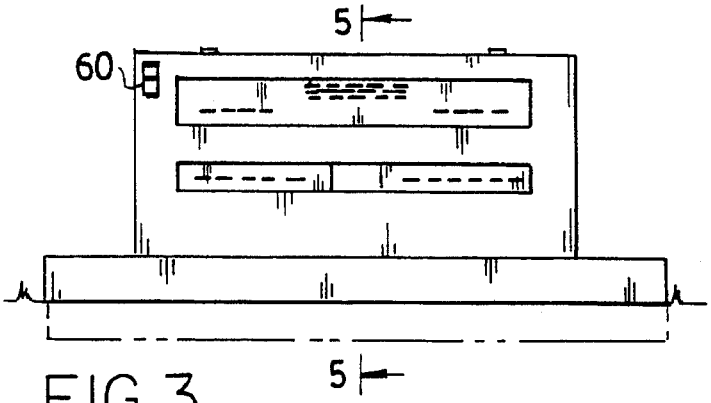
FIG. 3 is a front view of the monument structure of FIG. 1.
Figure 4:
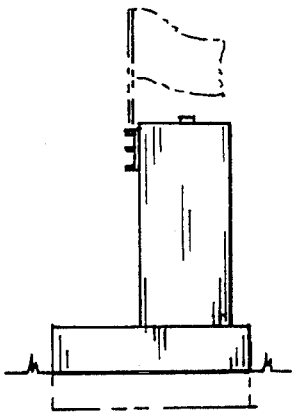
FIG. 4 is a side view of the monument structure of FIG. 1.

Referring to FIGS. 2 and 3, base 14 and/or monument 12 may be connected to a concrete base by conventional means.

Any conventional means for supporting monument 12 and/or base 14 may be used. Thus, by way of illustration and not limitation, one may use one or more of the concrete anchor arrangements well known to those skilled in the art. For example, one may use the devices illustrated in U.S. Pat.

Nos. 5,107,650 (concrete anchors), 5,074,095, 5,063,724 (anchor for fixing a rod in concrete), 5,049,015, 4,872,298, and the like. The disclosure of each of these United States patent applications is hereby incorporated by reference into this specification. Thus, e.g., the base 14 can be mounted on a concrete foundation which is disposed within ground 68 (see FIG. 5) This mounting means is well known to those skilled in the art. Thus, e.g., one may dig a suitable hole in the ground 68, and pour concrete within such hole and allow it to harden so that it fills all of such hole except for recesses; thereafter steel anchors may be attached.

Figure 5:
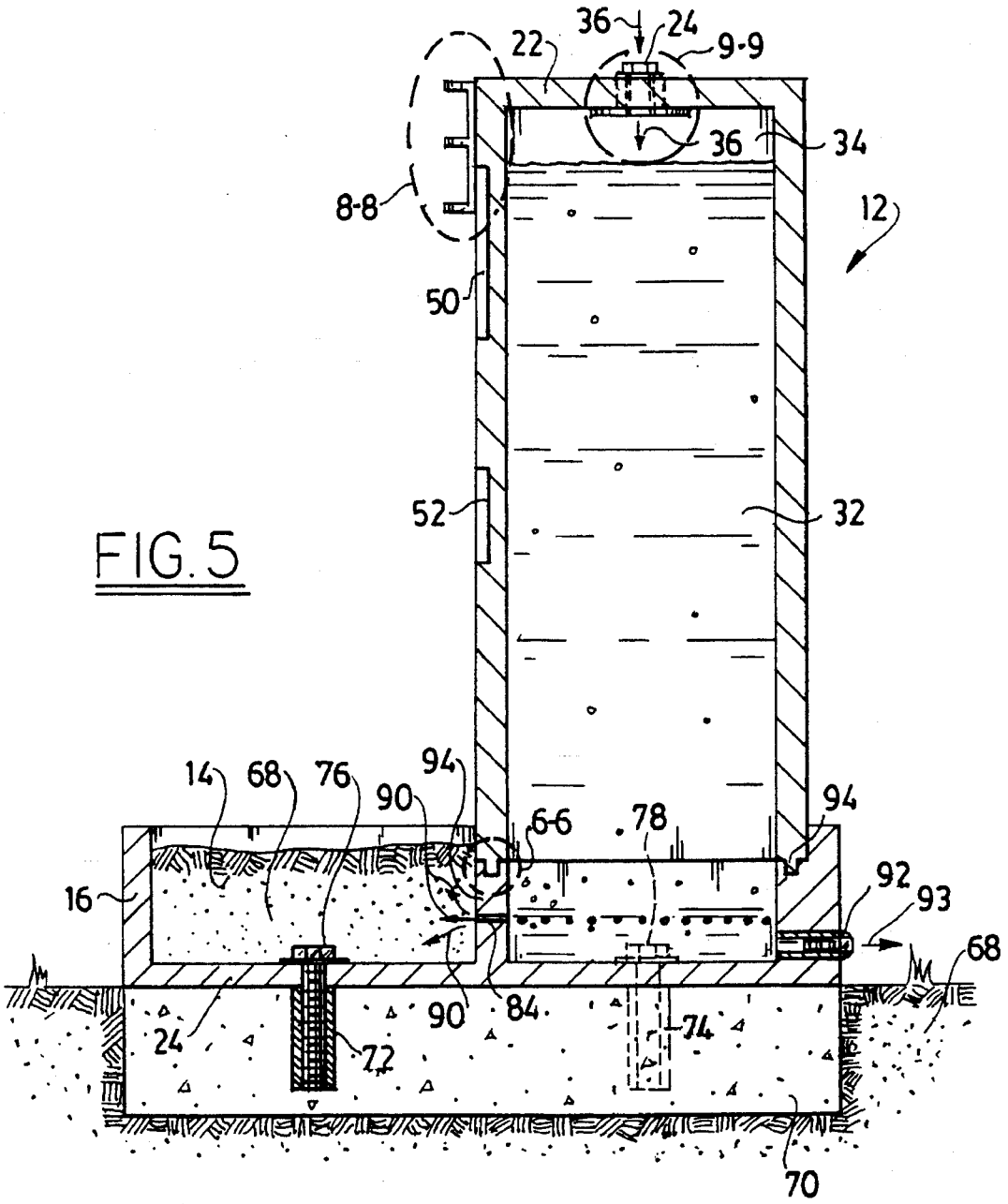
FIG. 5 is a sectional view of the monument structure of FIG. 1.

In the embodiment illustrated in FIG. 5, a recess is dug into ground 68 and filled with concrete 70. Lag screw receptacles 72 and 74 may be disposed within the concrete 70 (preferably when the concrete 70 is still fluid), and lag screws 76 and 78 then may be used to secure base 14 and/or monument 12 to the concrete 70.

Referring again to FIG. 1, and in the preferred embodiment depicted therein, it will be seen that base 14 defines a substantially rectangular container into which earth 68 may be charged. Flowers and/or other plants 80 (such as ivy) may then be planted within base 14. Water from the interior of monument 12 may then be used to nourish such plants.

Referring again to FIG. 5, it will be seen that, in the embodiment depicted, the base 12 is comprised of weep hole 84 which allows water from reservoir 88 in monument 12 to passes in the direction of arrow 90 and to water earth 68. When, however, one wishes to remove water from the reservoir 88 (such as, e.g., when winter is approaching), plug 92 may be moved in the direction of arrow 94 to allow water to escape therefrom and thereafter may be reinstalled.

Figure 8:
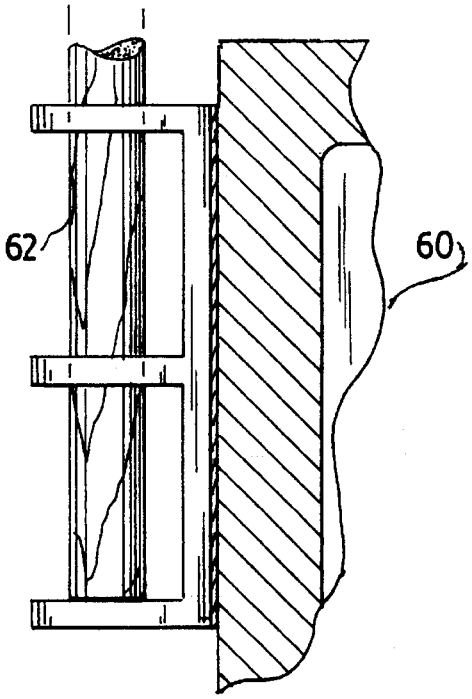
FIG. 8 is a side view of the flag holder of FIG. 7.

FIGS. 7 and 8 illustrate one preferred means of connecting monument 12 to base 14, by means of a tongue 94/groove 96 arrangement. The tongues 94 (see FIGS. 5) may be set within grooves 96 of base 14 and retained there by the force of gravity and by friction fit. Alternatively, or additionally, the tongues 94 may also be adhesively joined within grooves 96 by, e.g., suitable glue.

The advantages of applicant's novel monument structure are readily apparent. In the first place, because of its ceramic composition, it can be repaired more readily than can prior art monuments. In the second place, it can display more information (such as dates, times, achievements, colors, etc.) than can comparable prior art monuments; thus, e.g., a brass Veterans plaque can readily be secured to its back surface.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A monument assembly comprised of a monument attached to a base, wherein said assembly is adapted to be mounted on a cement block, and wherein:

(a) said base is an integral, open container assembly comprised of a bottom wall and a first side wall extending upwardly from said bottom wall and integrally connected thereto, wherein:

1. said bottom wall and said first side wall are each from about 0.5 to about 1.0 inches thick, and are comprised of at least about 90 weight percent of ceramic material, and
2. said bottom wall is comprised of means for securing said base to cement block;

(b) said monument is an integral assembly comprised of a top wall and a second downwardly-extending side wall integrally connected to said top wall, wherein:

1. said monument is comprised of an interior chamber encompassed by said top wall and said second downwardly-extending side wall,
2. said top wall and said second downwardly-extending side wall each have a thickness of from about 0.5 to about 1.0 inches and are comprised of at least about 90 weight percent of ceramic material,
3. said monument is comprised of means for charging water to said interior chamber,
4. said monument is comprised of means for removing water from said interior chamber,
5. said monument is comprised of means for removably attaching said monument to said base, and
6. at least one surface of said second downwardly-extending side wall is covered by glaze.

2. The monument assembly as recited in claim 1, wherein said base has a substantially rectilinear shape.

3. The monument assembly as recited in claim 2, wherein said monument has a substantially rectilinear shape.

4. The monument assembly as recited in claim 3, wherein each of the walls of said base is covered by glaze.

5. The monument assembly as recited in claim 4, wherein each of the walls of said monument is covered by glaze.

6. The monument assembly as recited in claim 5, wherein each of the walls of said base has a thickness of from about 0.5 to about 0.8 inches.

7. The monument assembly as recited in claim 6, wherein each of the walls of said monument has a thickness of from about 0.5 to about 0.8 inches.

8. The monument assembly as .recited in claim 7, wherein said ceramic material is terra cotta.

9. The monument assembly as recited in claim 8, wherein said monument is comprised of a top surface which comprises a first orifice and a second orifice.

10. The monument assembly as recited in claim 9, wherein a first plug is removably disposed within said first orifice.

11. The monument assembly as recited in claim 10, wherein a second plug is removably disposed within said second orifice.

12. The monument assembly as recited in claim 11, wherein said monument comprises a front face comprised of a first recess and a second recess.

13. The monument assembly as recited in claim 12, wherein a flag holder is attached to said monument.

14. The monument assembly as recited in claim 13, wherein said means for removably attaching said monument to said base comprises a first tongue and a second tongue.

15. The monument assembly as recited in claim 14, wherein said base is comprised of a first groove and a second groove in which said first tongue and said second tongue are disposed.

* * * * *